United States Patent [19]

Olsson

[11] 4,350,445

[45] Sep. 21, 1982

[54] PADDLE

[76] Inventor: Sven O. Olsson, 7019 Kerry Rd., Edina, Minn. 55435

[21] Appl. No.: 216,774

[22] Filed: Dec. 15, 1980

[51] Int. Cl.[3] ..... B01F 13/00

[52] U.S. Cl. ..... 366/343; 366/129; D7/138

[58] Field of Search ..... 366/343, 348, 349, 129, 366/605; D7/138; D32/46, 49

[56] References Cited

U.S. PATENT DOCUMENTS

| | | | |
|---|---|---|---|
| D. 188,593 | 8/1960 | Tegarty | D32/49 |
| D. 235,306 | 6/1975 | Christain | D7/138 |
| 1,498,509 | 6/1924 | Arnold | 366/343 |
| 2,777,676 | 1/1957 | Carter | 366/129 |
| 2,860,858 | 11/1958 | Kurs | 366/129 |
| 3,298,671 | 1/1967 | Popma | 366/343 |

OTHER PUBLICATIONS

Photograph No. 1—Sears paint paddle.
Photograph No. 2—Wards wood paint paddle.

*Primary Examiner*—Edward J. McCarthy
*Attorney, Agent, or Firm*—Burd, Bartz & Gutenkauf

[57] ABSTRACT

A paddle particularly adapted for use in stirring fluid such as paint and for scraping and measuring. The paddle includes a linear, elongate handle and a blade fixed to the handle having a leading side edge offset from the handle. A leading end edge is perpendicularly orientated relative to the leading side edge. A relatively narrow, resilient wiper lip extends along the leading side edge and leading end edge and is adapted for surface engagement of a surface to move fluid away therefrom as, for example, for engagement with the interior surfaces of a paint can. The blade and handle can have graduations to measure the depth of paint remaining in a paint can.

9 Claims, 10 Drawing Figures

PADDLE

SUMMARY OF THE INVENTION

The invention pertains to a paddle particularly adapted for use in the field of painting for stirring, scraping and measuring. In an unopened can of paint, much paint and pigmentation is prone to adhere to the sides and bottom of the can. Usual mixture procedures as by agitation or simply stirring might not be effective to dislodge this material which might subsequently dislodge and cause streaking in the paint.

The invention comprises a paddle having a handle portion and a blade portion. The blade portion includes a leading side edge and a leading end edge orientated generally in perpendicular relationship to the leading side edge. A relatively narrow, resilient wiper extends along the leading edges of the blade for contact with a surface such as the interior wall surface of a paint can to scrape and remove paint therefrom. The wiper is usable in scraping paint and like material from other surfaces. The handle portion extends angularly away from the blade portion with respect to the side leading edge so as to be easily grasped by an user. A concave curved section is located at the juncture of the handle and the blade and has a curvature approximating the curvature of a standard paint roller. The paddle can be drawn along a paint roller with the curved section in engagement with the surface of the paint roller to strip paint from the paint roller. The length of the paddle along the blade and handle can be calibrated to give an indication of the amount of paint remaining in a standard container according to the paint depth.

IN THE DRAWINGS

DESCRIPTION OF A PREFERRED EMBODIMENT

Figure 2:
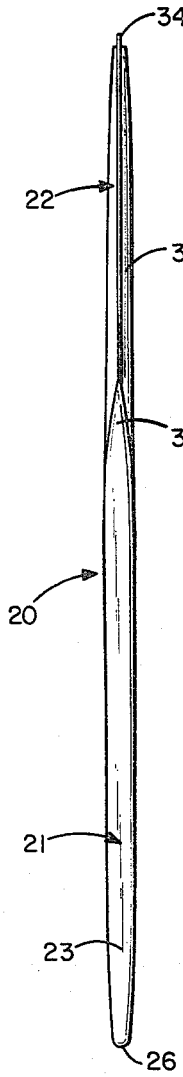
FIG. 2 is a side view of the paddle of FIG. 1 as when viewed from the left of FIG. 1.
Figure 1:
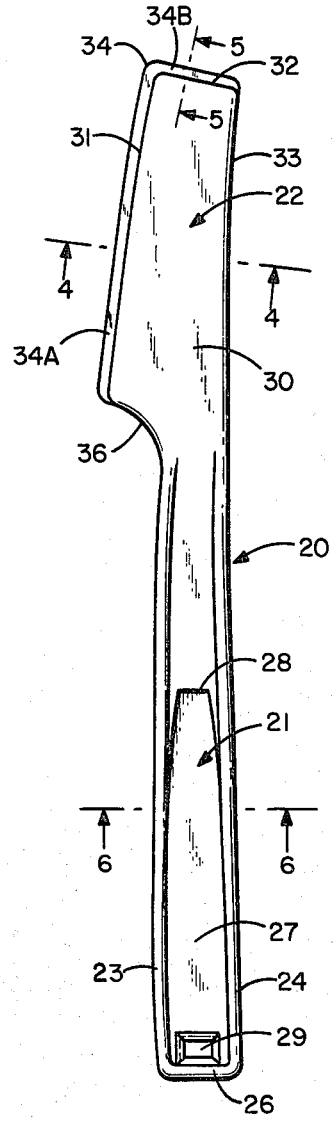
FIG. 1 is a side elevational view of a paddle according to the present invention.
Figure 3:
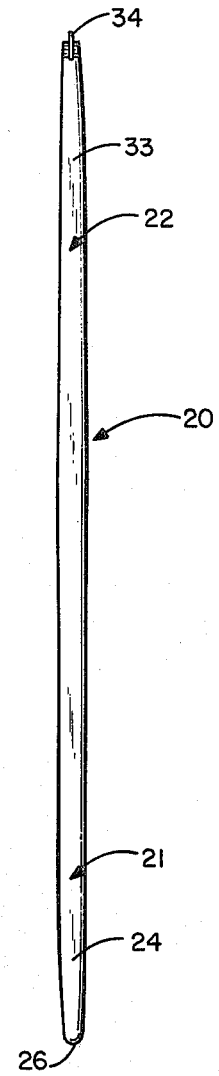
FIG. 3 is another side view of the paddle of FIG. 1 as when viewed from the right of FIG. 1.

Referring to the drawings, there is shown in FIG. 1 through 6 a paddle 20 according to the invention used for functions such as stirring paint or other fluids, scraping a fluid paint mixture from a surface such as the inner wall of a paint container, and stripping loose paint from a paint roller. Paddle 20 includes a handle 21 adapted to be manually grasped by an user, and a blade 22 integrally connected at one end to handle 21. Handle 21 is an elongate longitudinal member having raised side edges or ribs 23, 24, and a raised end rib 16 provided for purposes of rigidity, strength and comfort. A reduced flat transverse side edges or ribs 23, 24 blend into the blade 22. A reduced flat transverse midportion or base 27 is disposed intermediate the side edges 23, 24 and end edge 26. A raised ridge 28 is located intermediate the length of handle 21 on both sides of midportion 27 and blends into the blade 22. An opening 29 is provided at the end handle 21 for hanging paddle 20.

Figure 4:
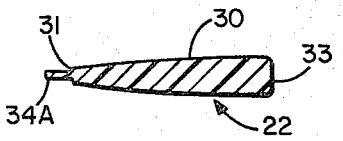
FIG. 4 is an enlarged sectional view of a portion of the paddle of FIG. 1 taken along the line 4—4 thereof.
Figure 5:
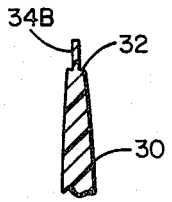
FIG. 5 is another enlarged sectional view of a portion of the paddle of FIG. 1 taken along the line 5—5 thereof.
Figure 6:
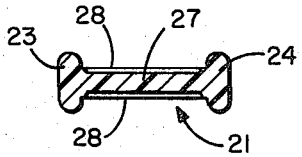
FIG. 6 is another enlarged sectional view of a portion of the paddle of FIG. 1 taken along the line 6—6 thereof.

Blade 22 has a base 30 that is wider than the transverse dimension of handle 21. As shown in FIGS. 4 and 5, base 30 of blade 22 transversely tapers to a first or leading side edge 31, and longitudinally tapers to a second or leading end edge 32 disposed in generally perpendicular orientation relative to the leading side edge 31. A relatively blunt trailing side edge 33 is disposed opposite leading side edge 31 on base 30 and is constituted as a substantially linear but slightly inwardly curved linear extension of one side edge 24 of handle 21. A relatively thin, resilient wiper lip 34 is extended along the leading edges 31, 32, having a first segment 34A extended along the leading end edge 32. Wiper lip 34 is relatively thin as compared with the thickness of the leading edges 31, 32 and can be constituted as an integrally molded extension thereof. Wiper lip 34 is adapted for engagement with a surface to strip or scrape fluid therefrom such as paint. Wiper lip 34 is also functional to move particulate matter along a solid, flat surface such as moving wood shavings off a work bench surface. Blade 22 can be formed of a relatively flexible material such as a molded plastic whereby base 30 is relatively flexible about an axis perpendicular to the plane of FIG. 2 and can be used as a spatula conformable to a curvature or irregular surface as when working with putty or wood filler. Blade 22 equipped with wiper lip 34 is also usable in other general scraping circumstances such as scrapping ice from an automobile windshield in the wintertime or the like.

Leading side edge 31 is offset from handle 21 and is angularly orientated relative to trailing side edge 33 in diverging relationship relative to handle 21. The interior corner of leading side edge 31 is connected to the adjacent side edge 23 of handle 21 by a concave arcuately curved segment 36. Curved segment 36 is formed along a circular arch of a circumference approximating that of a standard paint roller. Curved segment 36 is usable for engagement with a standard paint roller to strip off excess paint preparatory to final cleaning of the roller thereby to save paint and facilitate cleaning of the roller.

Figure 7:
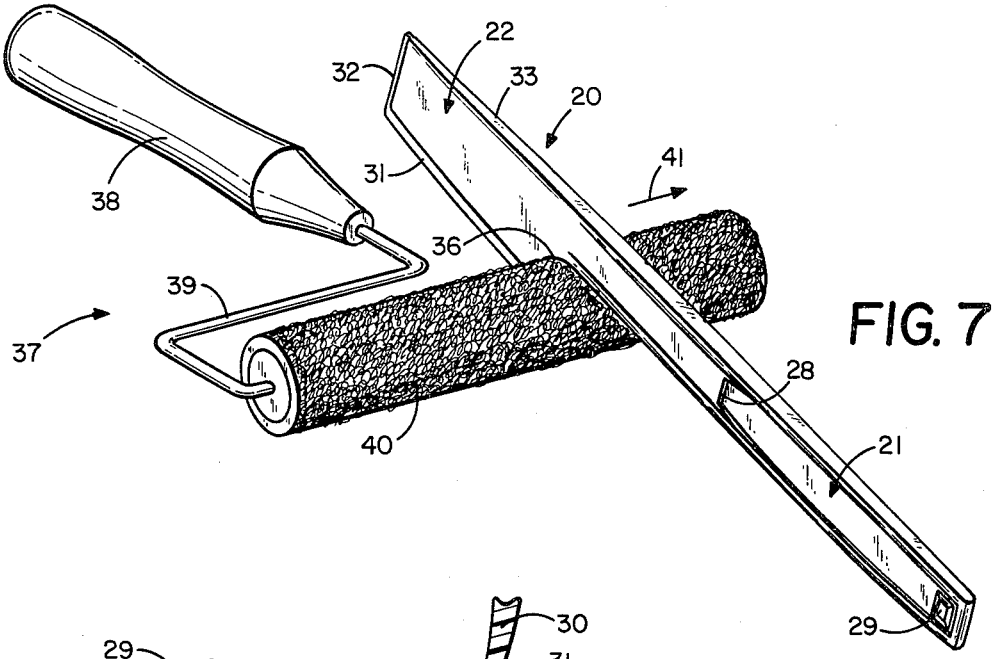
FIG. 7 is a perspective view of a paddle according to the invention in use with respect to a paint roller.

Exemplary uses of paddle 20 are illustrated in FIGS. 7 through 10. In FIG. 7, paddle 20 is shown in operative engagement with a paint roller assembly 37 of the type having a handle 38 and a frame 39 carrying a rotatable paint roller 40 with the usual nap surface to absorb and store a supply of paint to be applied to a wall or other flat surface. Curved segment 36 is in engagement with a portion of the circumference of roller 40. Upon movement of the paddle 20 along the axis of paint roller 40 in the direction of arrow 41, excess paint is stripped off the end of the paint roller 40 where it can be captured in a suitable container such as the paint can. Paint is saved and final cleaning of roller 40 is facilitated.

Figure 8:
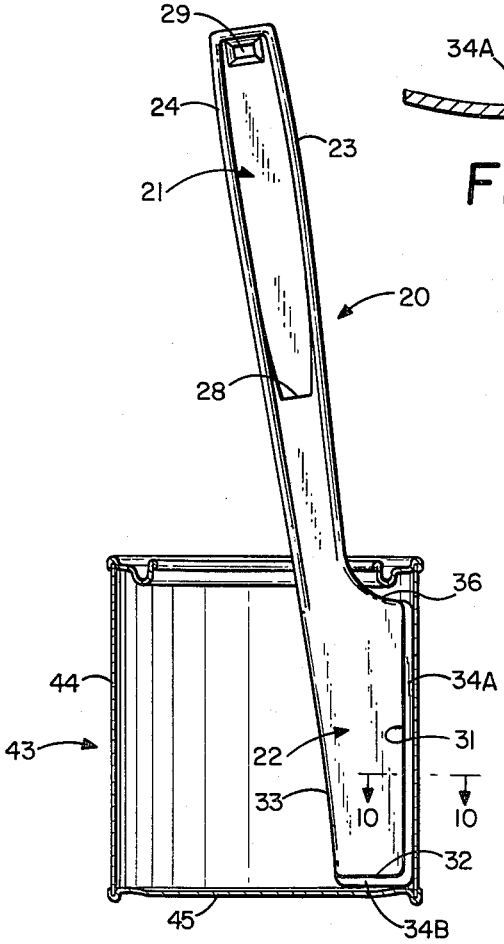
FIG. 8 is a view partly in section of a paddle of the invention in use with respect to a quart size paint can.

In FIG. 8, paddle 20 is shown installed in operative relationship to a standard one quart paint can 43 having cylindrical side walls 44 and a flat bottom 45. Manipulation of handle 21 imparts a stirring motion to blade 22 to stir and mix paint located in a can 43. In addition, leading side edge 31 can be pressed against the interior surface of sidewall 44 with wiper lip segment 34A in bearing relationship to the interior surface of sidewall 44 to move paint and pigment adhering to the surface away from the surface and into the main body of paint located in the can 43. At the same time, the leading end edge 32 can be pressed against the interior surface of the bottom wall 45 of paint can 43 with the second wiper lip segment 34B being in contact with bottom 45 to scrape and move paint and pigment away from the bottom surface 45 into the main body of paint located in can 43. With the leading side edge 31 disposed in a generally horizontal orientation in the can 43, the blunt trailing edge 33 is disposed at an angular inclination relative to a vertical direction as well as the handle 21 whereby the handle 21 is easily grasped for manipulation of the blade 22 in the can 43. The distance between the lower edge of second wiper lip segment 34B and the upper terminus of the leading side edge 31 of blade 33 is approximately equal to the level of paint in a standard one-quart paint can when it is full. Accordingly, the approximate amount of paint remaining in the paint can 43 can be gauged by comparing the level of the paint located in paint can 43 with respect to its position on the leading side edge 31 as compared to the upper terminus of the leading side edge 31.

Figure 10:
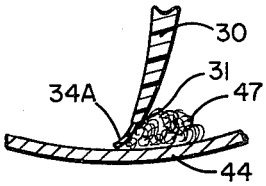
FIG. 10 is an enlarged sectional view of a portion of the paddle of FIG. 8 taken along the line 10—10 thereof.

As shown in FIG. 10, as the resilient wiper segment 34A is moved along the interior surface of sidewall 44 paint can 43, it flexes slightly to seal against the interior surface of sidewall 44 to ensure that all paint and pigment residue 47 clinging to the interior surface of sidewall 44 is removed therefrom. This ensures both thorough mixing of the paint located in the can 43 and usage of paint in the can that would otherwise cling to the walls.

Figure 9:
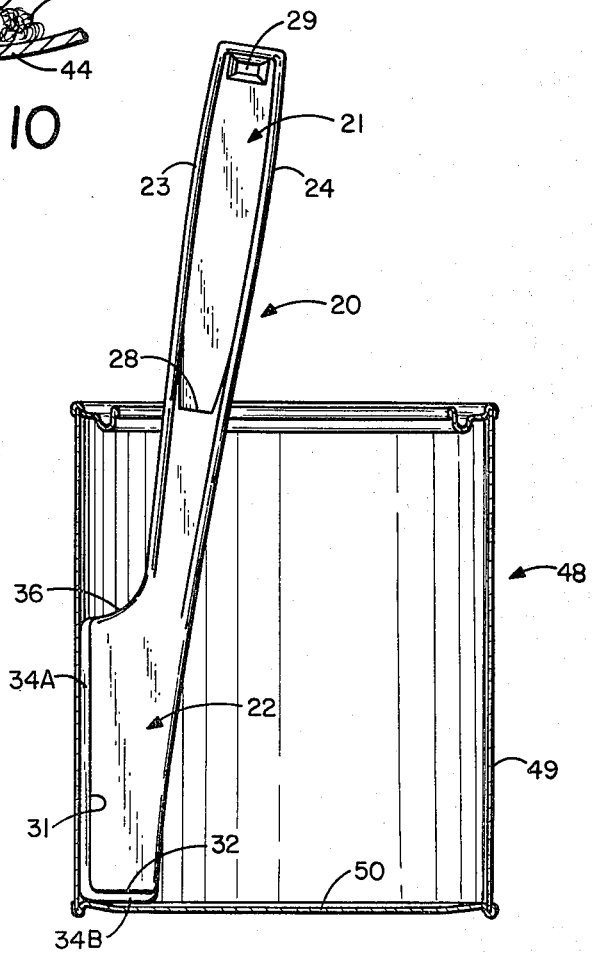
FIG. 9 is a plan view partly in section of a paddle according to the invention in use with respect to a larger sized paint can.

In FIG. 9, paddle 20 is shown installed in operative relationship to a standard size one-gallon paint can 48 having a cylindrical sidewall 49 and a bottom wall 50. By manipulation of the handle 21, the blade portion 22 is moved through the paint to stir and mix it. The leading side edge 31 can be moved into engagement with the interior surfaces of the cylindrical sidewalls 49 to remove attached paint and pigment to fully mix the paint and pigment. The wiper lip segment 34A connected to the first leading side edge 31 is engageable with the sidewall while the other wiper lip segment 34B connected to the leading end edge 32 is in surface contact with the bottom wall 50. The vertical distance between the end of the leg portion 22 in contact with the bottom wall 50, and the ridge 28 located intermediate on the handle 21 is equivalent to the level of paint in a standard size one-gallon paint can when it is full. The amount of paint remaining in the can 48 can be approximated by comparing the level of paint with respect to paddle 20 as compared to the vertical distance of ridge 28. Additional calibrations can be provided to show other proportionate amounts of paint remaining in paint can 48.

While there has been shown and described a preferred embodiment of a paddle according to the invention, it will be apparent to those skilled in the art that certain deviations and variations can be had from the embodiments shown without departing from the spirit and scope of the invention.

The embodiments of the invention in which an exclusive property or privilege is claimed are defined as follows:

1. A paddle usable for stirring a fluid, comprising:
an elongate linear handle having generally parallel side edges adapted to be grasped by an user for manipulation of the paddle;
a blade connected to the handle having a blade base with a width greater than the transverse dimension of the handle, said blade base having a relatively blunt trailing side edge substantially linear with one side edge of the handle, and a leading side edge offset from the handle and angularly orientated relative to the trailing side edge in diverging relationship to the handle and a leading end edge orientated in generally perpendicular relationship to the leading side edge;
an uninterrupted narrow resilient wiper lip extended from the leading side edge of the base and the leading end edge of the base adapted for surface engagement of a surface to move fluid away from the surface.

2. The paddle of claim 1 including: a concave arcuately curved edge segment located at the juncture of the handle and the leading side edge where the leading side edge is offset from the handle and having a curvature adapted to conform to the curvature of the perimeter of a standard paint roller.

3. The paddle of claim 1 wherein: said blade base is tapered from said trailing side edge toward said leading side edge.

4. The paddle of claim 2 wherein: the distance between the juncture of the handle and leading side edge, and the end of the wiper lip on the leading end edge is approximately equal to the depth of paint in a standard one-quart paint can when full.

5. The paddle of claim 4 including: a transverse ridge on the handle located from the end of the wiper lip on the leading end edge a distance approximately equal to the depth of paint in a standard one-gallon paint can when full.

6. A paddle usable for stirring a fluid, comprising:
an elongate linear handle having generally parallel side edges adapted to be grasped by an user for manipulation of the paddle;
a blade connected to the handle having a blade base with a width greater than the transverse dimension of the handle, said blade base having a relatively blunt trailing side edge substantially linear with one side edge of the handle and a leading side edge offset from the handle and angularly orientated relative to the trailing side edge in diverging relationship to the handle and a leading end edge orientated in generally perpendicular relationship to the leading side edge; and a concave arculately curved edge segment located at the juncture of the handle and the leading side edge where the leading side edge is offset from the handle constituted as an integral extension of one edge of the handle and having a curvature adapted to conform to the curvature of the perimeter of a standard paint roller.

7. The paddle of claim 6 wherein: the distance between the juncture of the handle and leading side edge, and the end of the wiper lip on the leading end edge is approximately equal to the depth of paint in a standard one-quart paint can when full.

8. The paddle of claim 7 including: a transverse ridge on the handle located from the end of the blade a distance approximately equal to the depth of paint in a standard one-gallon paint can when full.

9. The paddle of claim 6 wherein: said blade base is tapered from said trailing side edge toward said leading side edge.

* * * * *

UNITED STATES PATENT AND TRADEMARK OFFICE

CERTIFICATE OF CORRECTION

PATENT NO. : 4,350,445

DATED : September 21, 1982

INVENTOR(S) : Sven O. Olsson

It is certified that error appears in the above-identified patent and that said Letters Patent are hereby corrected as shown below:

Column 2, line 4, "16" should be -- 26 --.

Column 2, line 12, after "end" insert -- of --.

Column 2, line 41, "scrapping" should be -- scraping --.

Signed and Sealed this

*Twenty-second* Day of *February 1983*

[SEAL]

*Attest:*

GERALD J. MOSSINGHOFF

*Attesting Officer*

*Commissioner of Patents and Trademarks*